US012209780B2

(12) United States Patent
Takahashi et al.

(10) Patent No.: US 12,209,780 B2
(45) Date of Patent: Jan. 28, 2025

(54) DISTRIBUTOR, HEAT EXCHANGER AND AIR CONDITIONER

(71) Applicant: Mitsubishi Electric Corporation, Tokyo (JP)

(72) Inventors: Atsushi Takahashi, Tokyo (JP); Tsuyoshi Maeda, Tokyo (JP); Satoru Yanachi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 100 days.

(21) Appl. No.: 18/042,674

(22) PCT Filed: Oct. 21, 2020

(86) PCT No.: PCT/JP2020/039542
§ 371 (c)(1),
(2) Date: Feb. 23, 2023

(87) PCT Pub. No.: WO2022/085113
PCT Pub. Date: Apr. 28, 2022

(65) Prior Publication Data

US 2023/0358451 A1 Nov. 9, 2023

(51) Int. Cl.
*F25B 41/42* (2021.01)
*F25B 39/02* (2006.01)
(Continued)

(52) U.S. Cl.
CPC ..... *F25B 41/42* (2021.01); *F25B 39/022* (2013.01); *F25B 39/028* (2013.01); *F25B 39/04* (2013.01);
(Continued)

(58) Field of Classification Search
CPC ..... F25B 41/42; F25B 39/022; F25B 39/028; F25B 39/04; F25B 39/02;
(Continued)

(56) References Cited

U.S. PATENT DOCUMENTS

2016/0116231 A1 4/2016 Higashiiue et al.
2017/0328614 A1* 11/2017 Yokozeki ..... F25B 13/00
(Continued)

FOREIGN PATENT DOCUMENTS

EP 2998681 A1 * 3/2016 ..... F25B 39/00
EP 3217135 A1 * 9/2017 ..... F25B 39/00
(Continued)

OTHER PUBLICATIONS

Office Action mailed Oct. 10, 2023 in corresponding Japanese Patent Application No. 2022-556293 (and English translation).
(Continued)

*Primary Examiner* — Emmanuel E Duke
(74) *Attorney, Agent, or Firm* — Posz Law Group, PLC

(57) ABSTRACT

A distributor includes at least: a first flow path through which refrigerant flowing in from a refrigerant inflow unit flows in a first direction toward a heat transfer tube disposed on the side of a refrigerant outflow unit; two second flow paths branched from the first flow path; two third flow paths, through each of which the refrigerant flows in a second direction opposite to the first direction; two fourth flow paths, each of which is formed to protrude from a main body toward the second direction and through each of which the refrigerant flows in a third direction intersecting the two third flow paths; and two fifth flow paths, through each of which the refrigerant flows in the first direction.

7 Claims, 8 Drawing Sheets

(51) Int. Cl.
*F25B 39/04* (2006.01)
*F28F 9/02* (2006.01)

(52) U.S. Cl.
CPC .... *F28F 9/0275* (2013.01); *F25B 2339/0241* (2013.01); *F25B 2339/041* (2013.01); *F25B 2339/043* (2013.01)

(58) Field of Classification Search
CPC ..... F25B 2339/0241; F25B 2339/041; F25B 2339/043; F28F 9/0275; F28F 9/0278; F28D 1/05383; F28D 2021/0061
See application file for complete search history.

(56) References Cited

U.S. PATENT DOCUMENTS

| | | | |
|---|---|---|---|
| 2017/0328652 | A1 | 11/2017 | Matsui et al. |
| 2019/0170456 | A1 | 6/2019 | Matsui et al. |

FOREIGN PATENT DOCUMENTS

| | | | | |
|---|---|---|---|---|
| EP | 3499169 | A1 * | 6/2019 | ..... F25B 39/00 |
| JP | 11-118295 | A | 4/1999 | |
| JP | 2001-133078 | A | 5/2001 | |
| JP | 2010-156501 | A | 7/2010 | |
| JP | 6214789 | B2 | 10/2017 | |
| WO | 2014/184913 | A1 | 11/2014 | |
| WO | 2014/184914 | A1 | 11/2014 | |
| WO | 2017/042867 | A1 | 3/2017 | |
| WO | 2019/073610 | A1 | 4/2019 | |

OTHER PUBLICATIONS

International Search Report of the International Searching Authority mailed Jan. 12, 2021 for the corresponding International application No. PCT/JP2020/039542 (and English translation).
Extended European Search Report mailed Oct. 30, 2023 in corresponding European Patent Application No. 20958666.8.
Office Action mailed Feb. 6, 2024 in corresponding Japanese Patent Application No. 2022-556293 (and English translation).

* cited by examiner

DISTRIBUTOR, HEAT EXCHANGER AND AIR CONDITIONER

CROSS REFERENCE TO RELATED APPLICATION

This application is a U.S. national stage application of PCT/JP2020/039542 filed on Oct. 21, 2020, the contents of which are incorporated herein by reference.

TECHNICAL FIELD

The present disclosure relates to a distributor, a heat exchanger and an air conditioner.

BACKGROUND ART

Conventionally, a distributor is configured to distribute refrigerant to each of a plurality of heat transfer tubes with a space being interposed between the plurality of heat transfer tubes. PTL 1 discloses a distributor in which a plurality of plate members are stacked to form a flow path of refrigerant.

CITATION LIST

Patent Literature

PTL 1: Japanese Patent No. 6214789

SUMMARY OF INVENTION

Technical Problem

As the number of the plate members laminated in the conventional distributor increases, the distributor becomes larger in size.

An object of the present disclosure is to provide a distributor, a heat exchanger and an air conditioner, each of which is compact in size.

Solution to Problem

The distributor of the present disclosure distributes refrigerant to each of a plurality of heat transfer tubes with a space being interposed between the plurality of heat transfer tubes. The distributor includes: a first flow path through which the refrigerant flowing in from an inflow port flows in a first direction toward the heat transfer tubes disposed on the side of an outflow port; two second flow paths branched from the first flow path in a direction intersecting the first flow path; two third flow paths, through each of which the refrigerant from a corresponding one of the two second flow paths flows in a second direction opposite to the first direction; two fourth flow paths, each of which is formed to protrude in the second direction from a main body of the distributor on the side of the inflow port, and through each of which the refrigerant from a corresponding one of the two third flow paths flows in a third direction intersecting each of the two third flow paths; and two fifth flow paths, through each of which the refrigerant from a corresponding one of the two fourth flow paths flows in the first direction.

Advantageous Effects of Invention

According to the present disclosure, it is possible to provide a distributor, a heat exchanger, and an air conditioner, each of which is compact in size.

DESCRIPTION OF EMBODIMENTS

Figure 1:
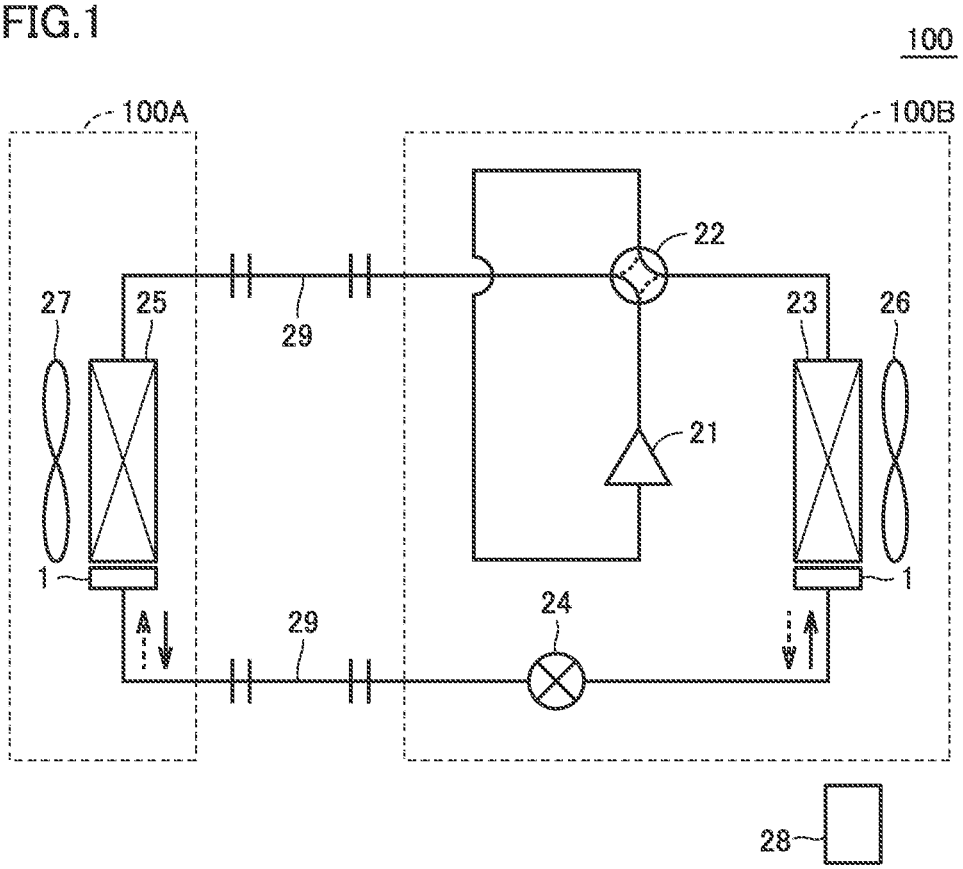
FIG. 1 is a diagram illustrating an air conditioner according to a first embodiment.

Hereinafter, embodiments of the present disclosure will be described in detail with reference to the drawings. In the embodiments to be described below, when a reference is made to a number, an amount or the like, the scope of the present disclosure is not necessarily limited to the number, the amount or the like unless otherwise specified. The same or equivalent components are denoted by the same reference numerals, and the description thereof may not be repeated. It is intended from the beginning that the embodiments may be combined appropriately.

First Embodiment

Figure 2:
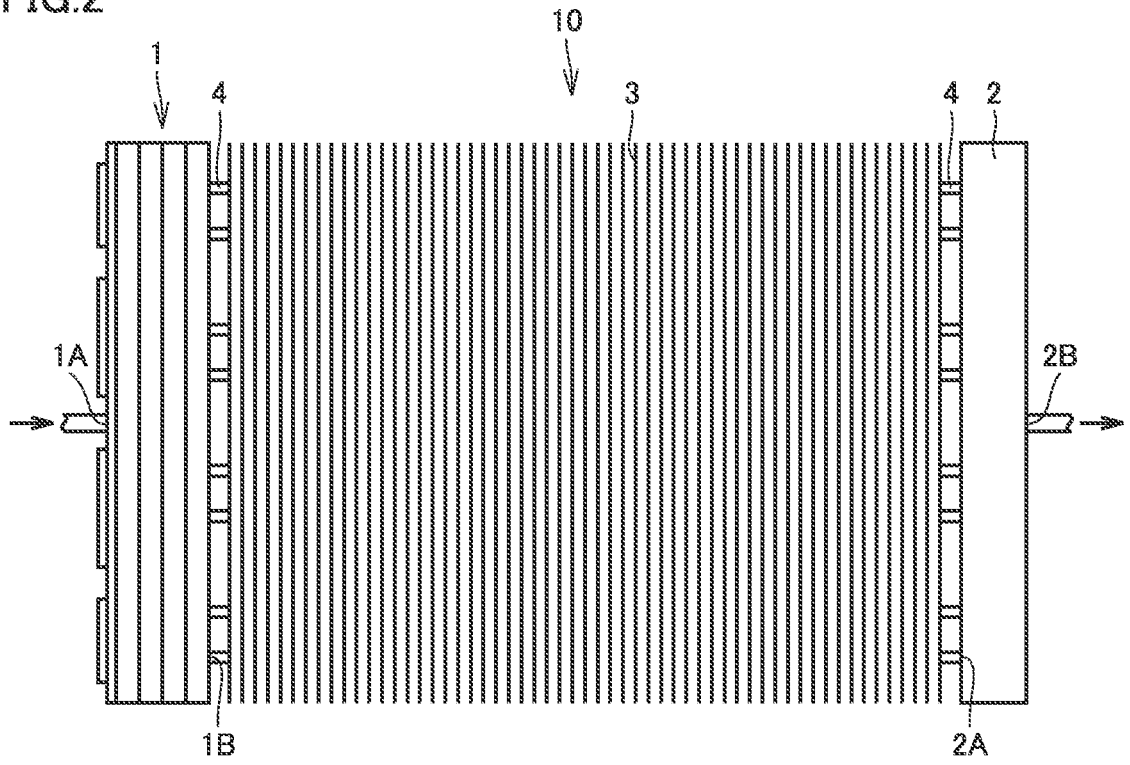
FIG. 2 is a diagram illustrating a heat exchanger according to the first embodiment.

FIG. 1 is a diagram illustrating an air conditioner 100 according to a first embodiment, and FIG. 2 is a diagram illustrating a heat exchanger 10 according to the first embodiment. FIG. 1 illustrates the functional connection and arrangement of each unit in the air conditioner 100, and does not necessarily define the physical connection and arrangement of each unit. Hereinafter, the description will be carried out by assuming that the heat exchanger according to the first embodiment is used in the air conditioner 100, but the present disclosure is not limited thereto. For example, the heat exchanger may be used in a refrigeration cycle apparatus with a refrigerant circulation circuit. Although the air conditioner 100 is described as being capable to switch between a cooling operation and a heating operation, the air conditioner 100 is not limited thereto, and may be configured to perform only the cooling operation or the heating operation.

<Configuration of Air Conditioner>

The air conditioner 100 according to the first embodiment will be described in detail. As illustrated in FIG. 1, the air conditioner 100 includes a compressor 21, a four-way valve 22, an outdoor heat exchanger (heat exchanger on heat source side) 23, a throttle device 24, an indoor heat exchanger (heat exchanger on load side) 25, an outdoor fan (fan on heat source side) 26, an indoor fan (fan on load side) 27, and a controller 28. The air conditioner 100 is constructed by an indoor unit 100A that includes the indoor heat exchanger 25 and an outdoor unit 100B that includes the outdoor heat exchanger 23 which are connected by an extension pipe 29. In the air conditioner 100, the compressor 21, the four-way valve 22, the outdoor heat exchanger 23, the throttle device 24, and the indoor heat exchanger 25 are connected by refrigerant pipes to form a refrigerant circulation circuit. In FIG. 1, the flow of refrigerant during the cooling operation is indicated by dotted arrows, and the flow of refrigerant during the heating operation is indicated by solid arrows.

The compressor 21, the four-way valve 22, the throttle device 24, the outdoor fan 26, the indoor fan 27, various sensors and the like are connected to the controller 28. The controller 28 switches the flow path of the four-way valve 22 so as to switch the cooling operation and the heating operation.

The flow of the refrigerant during the cooling operation will be described. The high-pressure high-temperature gas refrigerant discharged from the compressor 21 flows into the outdoor heat exchanger 23 through the four-way valve 22, and is condensed by exchanging heat with air supplied by the outdoor fan 26. The condensed refrigerant becomes a high-pressure liquid refrigerant, flows out from the outdoor heat exchanger 23, and is converted into a low-pressure gas-liquid two-phase refrigerant by the throttle device 24. The low-pressure gas-liquid two-phase refrigerant flows into the indoor heat exchanger 25 and is evaporated by exchanging heat with the air supplied by the indoor fan 27, thereby cooling the room. The evaporated refrigerant becomes a low-pressure gas refrigerant, flows out from the indoor heat exchanger 25, and is sucked into the compressor 21 through the four-way valve 22.

The flow of the refrigerant during the heating operation will be described. The high-pressure high-temperature gas refrigerant discharged from the compressor 21 flows into the indoor heat exchanger 25 through the four-way valve 22, and is condensed by exchanging heat with air supplied by the indoor fan 27, thereby heating the room. The condensed refrigerant becomes a high-pressure liquid refrigerant, flows out from the indoor heat exchanger 25, and is converted into a low-pressure gas-liquid two-phase refrigerant by the throttle device 24. The low-pressure gas-liquid two-phase refrigerant flows into the outdoor heat exchanger 23, and is evaporated by exchanging heat with the air supplied by the outdoor fan 26. The evaporated refrigerant becomes a low-pressure gas refrigerant, flows out from the outdoor heat exchanger 23, and is sucked into the compressor 21 through the four-way valve 22.

The heat exchanger 10 illustrated in FIG. 2 is used as at least one of the outdoor heat exchanger 23 and the indoor heat exchanger 25. When the heat exchanger 10 functions as an evaporator, the refrigerant flows in from the distributor 1 and flows out to the header 2. When the heat exchanger 10 functions as an evaporator, the gas-liquid two-phase refrigerant flows from the refrigerant pipe into the distributor 1, and is branched into each heat transfer tube 4 of the heat exchanger 10. When the heat exchanger 10 functions as a condenser, the liquid refrigerant from each heat transfer tube 4 flows into the distributor 1 and is merged therein, and then flows out into the refrigerant pipe.

<Configuration of Heat Exchanger>

The heat exchanger 10 according to the first embodiment will be described in detail. In the following description, the distributor 1 is configured to distribute the refrigerant into the heat exchanger 10, and however, the distributor 1 may be configured to distribute the refrigerant into any other device. The configurations, operations and the like to be described below are merely examples, and the distributor 1 is not limited to these configurations, operations and the like. Detailed structures will be simplified or omitted as appropriate. The descriptions for the same or similar components will be simplified or omitted as appropriate.

As illustrated in FIG. 2, the heat exchanger 10 includes the distributor 1, the header 2, a plurality of fins 3, and a plurality of heat transfer tubes 4.

The distributor 1 includes one refrigerant inflow unit 1A and a plurality of refrigerant outflow units 1B. The header 2 includes a plurality of refrigerant inflow units 2A and one refrigerant outflow unit 2B. The refrigerant inflow unit 1A of the distributor 1 and the refrigerant outflow unit 2B of the header 2 are connected to the refrigerant pipes of the refrigeration cycle apparatus. The plurality of heat transfer tubes 4 are connected between the refrigerant outflow unit 1B of the distributor 1 and the refrigerant inflow unit 2A of the header 2.

Each heat transfer tube 4 is a flat tube with a plurality of flow paths formed therein. Each heat transfer tube 4 is made of aluminum, for example. One end of each heat transfer tube 4 on the side of the distributor 1 is connected to the refrigerant outflow unit 1B of the distributor 1. The plurality of fins 3 are attached to the plurality of heat transfer tubes 4. Each of the plurality of fins 3 is made of aluminum, for example. The plurality of fins 3 are attached to the plurality of heat transfer tubes 4 by brazing. Although FIG. 2 illustrates that the number of the plurality of heat transfer tubes 4 is eight, the present disclosure is not limited thereto. In addition, the heat transfer tube 4 may have another shape such as a circular tube with a plurality of flow paths formed therein. The heat transfer tubes 4 and the fins 3 may be made of other metal such as copper.

<Flow of Refrigerant in Heat Exchanger>

The flow of the refrigerant in the heat exchanger 10 according to the first embodiment will be described below. When the heat exchanger 10 functions as an evaporator, the refrigerant flown through the refrigerant pipe flows into the distributor 1 through the refrigerant inflow unit 1A and is distributed by the distributor 1 into the plurality of heat transfer tubes 4 through the plurality of refrigerant outflow units 1B. The refrigerant flowing in the plurality of heat transfer tubes 4 exchanges heat with air or the like supplied by a blower. The refrigerant flown through the plurality of heat transfer tubes 4 flows into the header 2 through the plurality of refrigerant inflow units 2A and is merged therein, and then flows out into the refrigerant pipe through the refrigerant outflow unit 2B. When the heat exchanger 10 functions as a condenser, the refrigerant flows in a direction opposite to the flow mentioned above.

<Configuration of Distributor>

Figure 3:
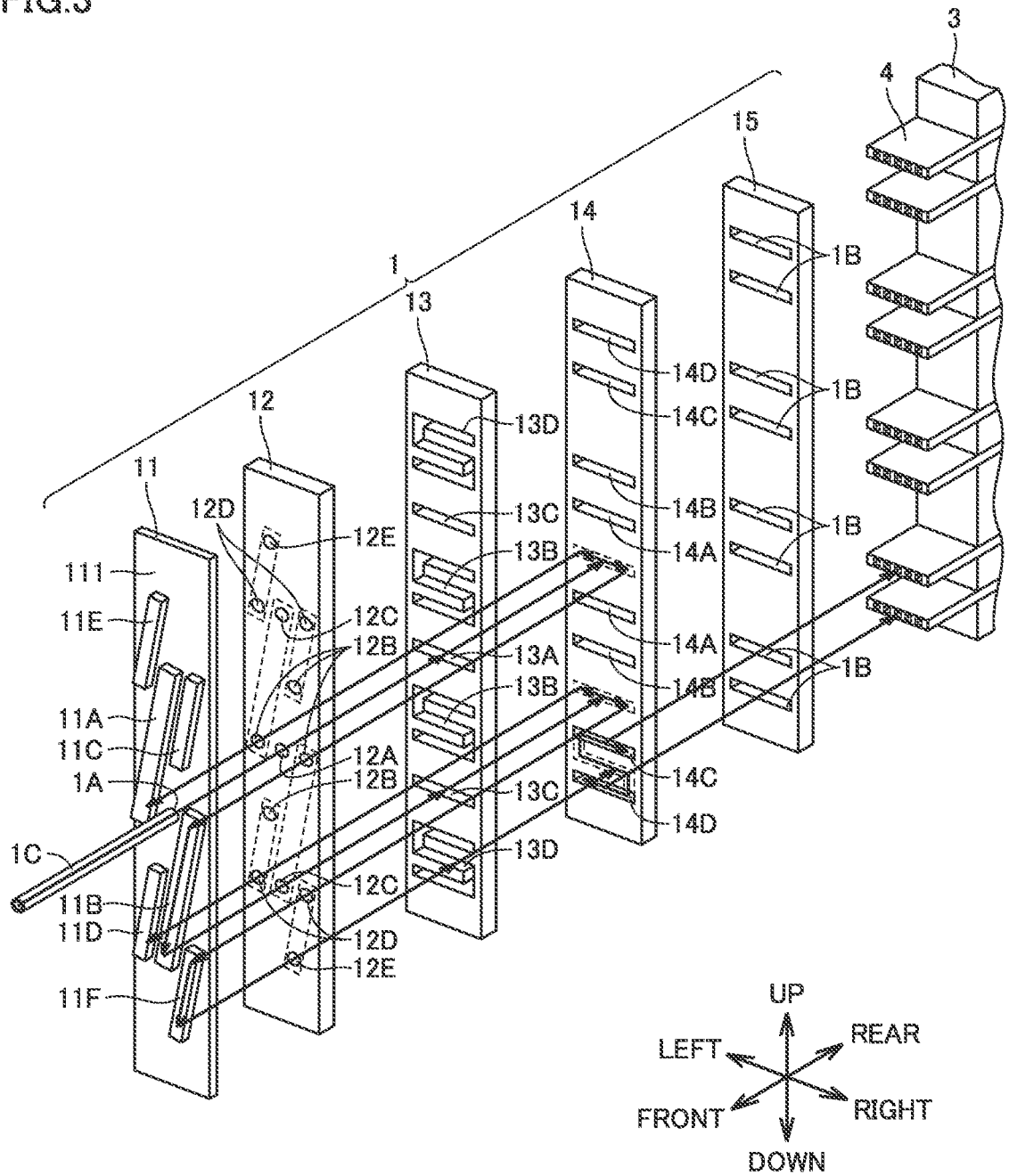
FIG. 3 is an exploded perspective view illustrating a distributor according to the first embodiment.

The configuration of the distributor 1 of the heat exchanger 10 according to the first embodiment will be described below. FIG. 3 is an exploded perspective view illustrating the distributor 1 according to the first embodiment. As illustrated in FIG. 3, the distributor 1 includes a first plate member 11, a second plate member 12, a third plate member 13, a fourth plate member 14, and a fifth plate member 15. The first plate member 11, the second plate member 12, the third plate member 13, the fourth plate member 14 and the fifth plate member 15 are laminated and joined together by brazing. Each of the first plate member 11, the second plate member 12, the third plate member 13, the fourth plate member 14, and the fifth plate member 15 has a thickness of, for example, about 1 to 10 mm, and is made of aluminum.

The first plate member 11 includes a plurality of convex portions 11A, 11B, 11C, 11D, 11E and 11F, each of which protrudes frontward from the main body 111. The first plate member includes an inflow pipe 1C protruding frontward and a refrigerant inflow unit 1A connected to the inflow pipe 1C. The second plate member 12 is provided with a plurality of circular holes 12A, 12B, 12C, 12D and 12E. The third plate member 13 is provided with long holes 13A and 13C extending in the left-right direction and S-shaped holes 13B and 13D. The fourth plate member 14 is provided with long holes 14A, 14B, 14C and 14D extending in the left-right direction. The fifth plate member 15 is provided with a plurality of through holes extending in the left-right direction which serve as the plurality of refrigerant outflow units 1B.

Each plate member is processed by press working or cutting. The first plate member 11 is processed, for example, by press working. Each of the second plate member 12, the third plate member 13, the fourth plate member 14, and the fifth plate member 15 is processed, for example, by cutting.

The distributor 1 is disposed in such a manner that the flow direction of the refrigerant in each of the plurality of heat transfer tubes 4 connected to the heat exchanger 10 is horizontal. The distributor 1 may be disposed in such a manner that the flow direction of the refrigerant in each of the plurality of heat transfer tubes 4 connected to the heat exchanger 10 is vertical. The distributor 1 may be disposed in such a manner that the flow direction of the refrigerant in each of the plurality of heat transfer tubes 4 connected to the heat exchanger 10 is oblique.

<Part of Flow of Refrigerant in Distributor>

In FIG. 3, a part of the flow of the refrigerant is indicated by arrows. The direction of each arrow indicates the flow direction of the refrigerant. Hereinafter, a part of the flow of the refrigerant will be described. The refrigerant that has flown through the inflow pipe 1C flows from the refrigerant inflow unit 1A into the hole 12A of the second plate member 12, collides with the surface of the fourth plate member 14, and thereby is branched in the left-right direction along the hole 13A of the third plate member 13. The branched refrigerant flows through the hole 12B of the second plate member 12 from the rear direction toward the front direction, and collides with the convex portion 11A and the convex portion 11B of the first plate member 11.

Among the refrigerant that collides with the convex portions, the refrigerant that collides with the convex portion 11B of the first plate member 11 flows obliquely downward along the convex portion 11B. The refrigerant flowing obliquely downward flows through the hole 12C of the second plate member 12, collides with the surface of the fourth plate member 14, and thereby is branched in the left-right direction along the hole 13C of the third plate member 13. The branched refrigerant flows through the hole 12D of the second plate member 12 from the rear direction toward the front direction, and collides with the convex portion 11D and the convex portion 11F of the first plate member 11.

Among the refrigerant that collides with the convex portions, the refrigerant that collides with the convex portion 11F of the first plate member 11 flows obliquely downward along the convex portion 11F. The refrigerant flowing obliquely downward flows through the hole 12E of the second plate member 12, collides with the surface of the fourth plate member 14, and thereby is branched into the upper side and the lower side of the S shape along the hole 13D of the third plate member 13. The refrigerant in the upper side of the S-shape flows through the hole 14C of the fourth plate member 14, and then flows through the refrigerant outflow unit 1B of the fifth plate member 15 into the heat transfer tube 4. The refrigerant in the lower side of the S-shape flows through the hole 14D of the fourth plate member 14, and then flows through the refrigerant outflow unit 1B of the fifth plate member 15 into the heat transfer tube 4.

<Detailed Flow of refrigerant in Distributor>

Figure 4:
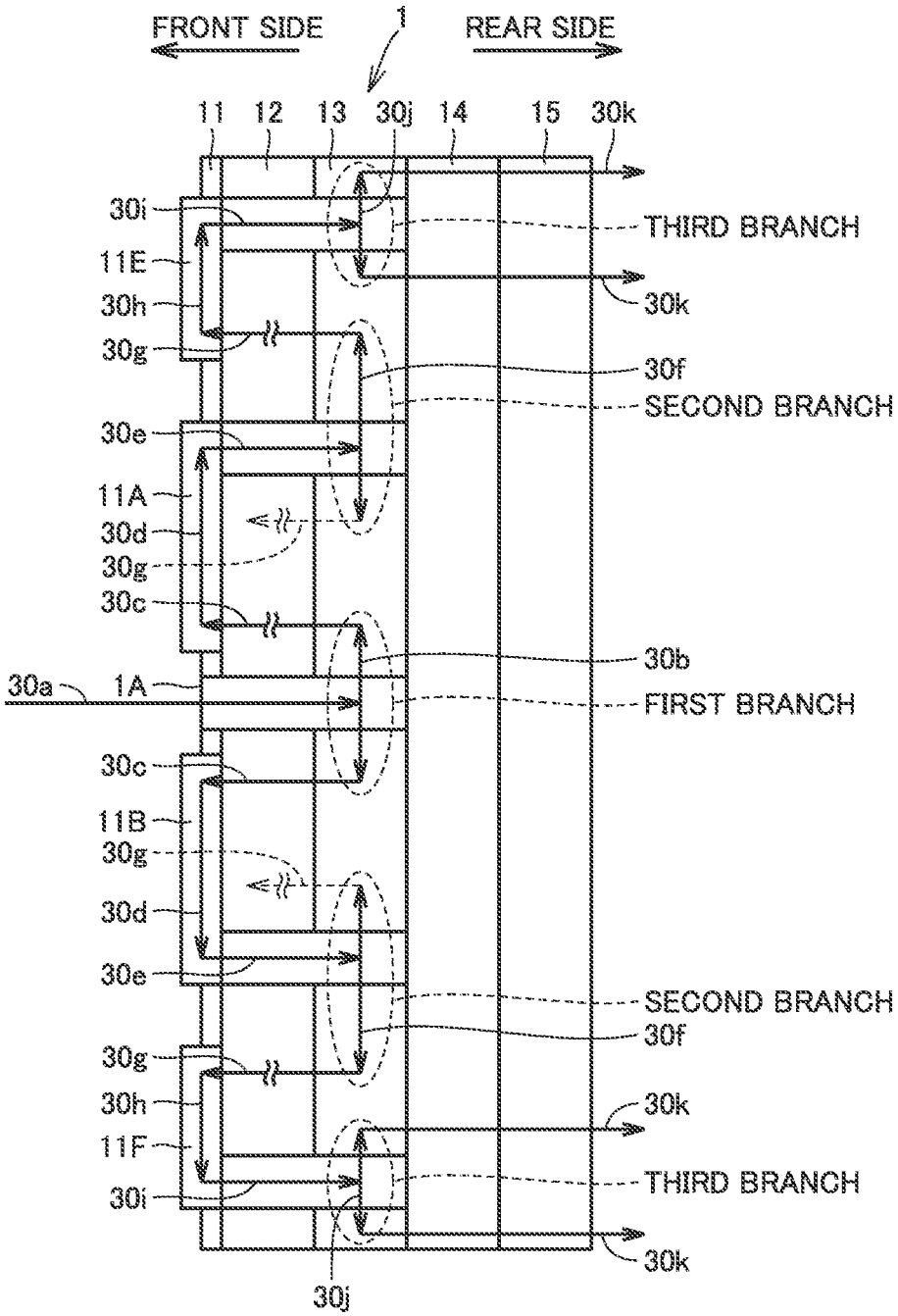
FIG. 4 is a diagram illustrating a flow of refrigerant.
Figure 5:
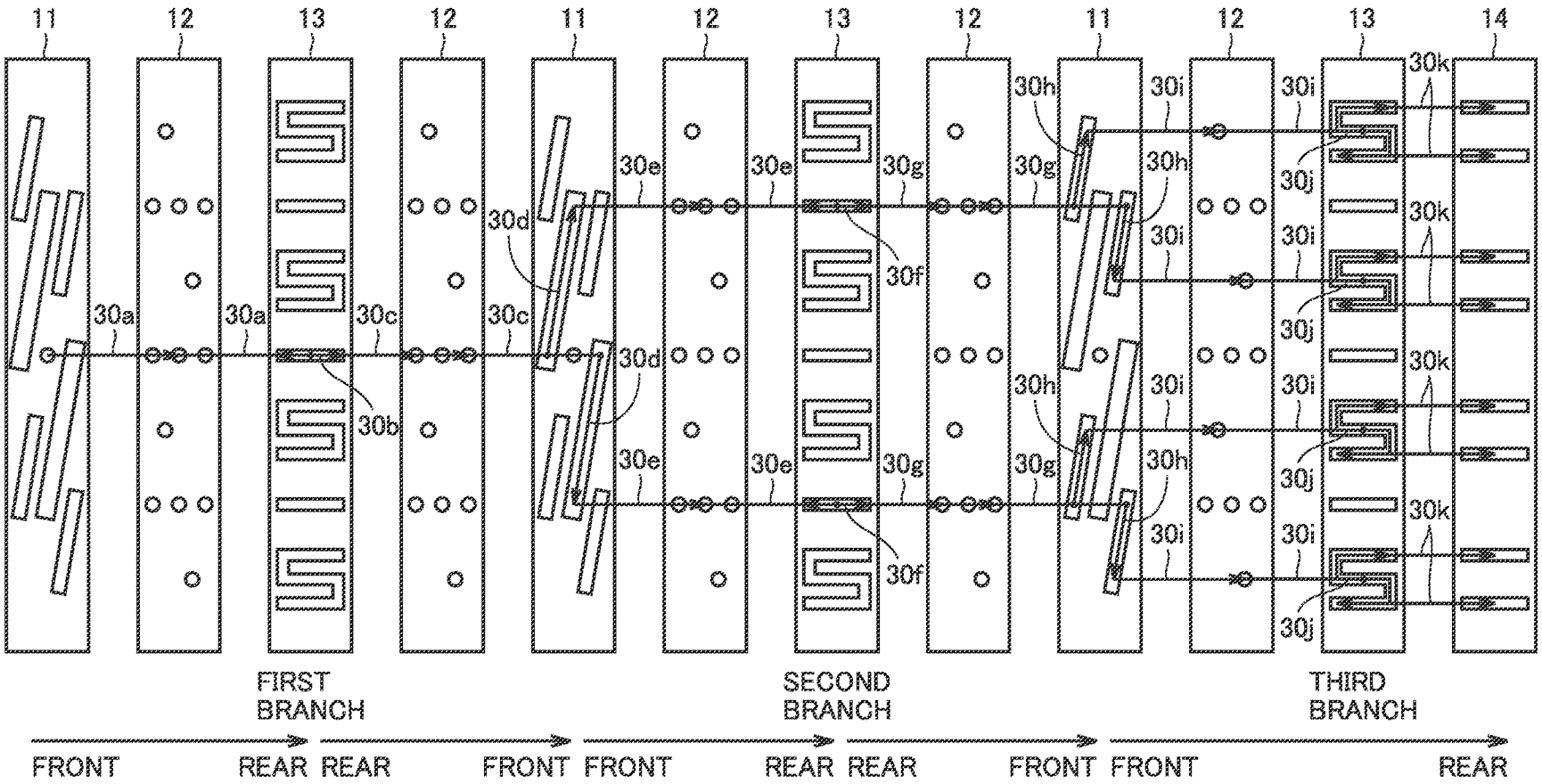
FIG. 5 is a diagram illustrating a flow of refrigerant.

The flow of the refrigerant in the distributor 1 will be described in detail with reference to FIGS. 4 and 5. FIGS. 4 and 5 are diagrams illustrating the flow of the refrigerant. In FIG. 4, arrows are used to schematically illustrate a flow path of the refrigerant from a side direction of the distributor 1. In FIG. 4, a part of the flow path is omitted for simplicity. As illustrated in FIG. 4, the first plate member 11, the second plate member 12, the third plate member 13, the fourth plate member 14, and the fifth plate member 15 in the distributor 1 are stacked in this order from the front side to the rear side. Regarding the convex portions of the first plate member 11, for the convenience of explanation, the convex portion 11A, the convex portion 11B, the convex portion 11E, and the convex portion 11F are illustrated, but the convex portion 11C and the convex portion 11D are not illustrated.

The refrigerant from the refrigerant inflow unit 1A flows through the first flow path 30*a* in a direction from the front side to the rear side. The refrigerant flown through the first flow path 30*a* is branched at the third plate member 13 (a first branch), and thereby flows into the two second flow paths 30*b* which intersect the first flow path 30*a*. The refrigerant flown through the two second flow paths 30*b* flows into the two third flow paths 30*c* in a direction from the rear side to the front side which is opposite to the flow direction of the refrigerant in the first flow path 30*a*.

The refrigerant flown through the two third flow paths 30*c* is guided by the convex portion 11A and the convex portion 11B of the first plate member 11, and thereby flows into the two fourth flow paths 30*d* which intersect the two third flow paths 30*c*. The refrigerant flown through the two fourth flow paths 30*d* flows into the two fifth flow paths 30*e* in a direction from the front side to the rear side.

The refrigerant flown through the two fifth flow paths 30*e* is branched at the third plate member 13 (a second branch), and thereby flows into the four sixth flow paths 30*f* which intersect the two fifth flow paths 30*e*. The refrigerant flown through the four sixth flow paths 30*f* flows into the four seventh flow paths 30*g* in a direction from the rear side to the front side which is opposite to the flow direction of the refrigerant in the fifth flow path 30*e*.

The refrigerant flown through the four seventh flow paths 30*g* is guided by the convex portions 11E and the convex portions 11F of the first plate member 11 and the convex portions 11C and the convex portions 11D (none is illustrated in FIG. 4) of the first plate member 11, and thereby flows into the four eighth flow paths 30*h* which intersect the four seventh flow paths 30*g*. The refrigerant flown through the four eighth flow paths 30*h* flows into the four ninth flow paths 30*i* in a direction from the front side to the rear side.

The refrigerant flown through the four ninth flow paths 30*i* is branched at the third plate member 13 (a third branch), and thereby flows into the eight tenth flow paths 30*j* which intersect the four ninth flow paths 30*i*. The refrigerant flown through the eight tenth flow paths 30*j* flows into the eight tenth flow paths 30*k* in a direction from the front side to the rear side which is the same as the flow direction of the refrigerant in the ninth flow paths 30*i*.

In order to clearly illustrate how the refrigerant is branched, the first plate member 11, the second plate member 12, the third plate member 13, and the fourth plate member 14 are unfolded and arranged side by side in FIG. 5. The refrigerant flows in the first flow path 30*a* formed by the first plate member 11, the second plate member 12, and the third plate member 13 in a direction from the front side to the rear side. The refrigerant flown through the first flow path 30*a* flows into the two second flow paths 30*b* formed in the third plate member 13 (the first branch).

The refrigerant flown through the two second flow paths 30*b* flows into the third flow path 30*c* formed by the third plate member 13, the second plate member 12, and the first plate member 11 in a direction from the rear side to the front side. The refrigerant flown through the two third flow paths 30*c* flows into the two fourth flow paths 30*d* formed in the first plate member 11.

The refrigerant flown through the two fourth flow paths 30*d* flows into the two fifth flow paths 30*e* formed by the first plate member 11, the second plate member 12, and the third plate member 13 in a direction from the front side to the rear side. The refrigerant flown through the two fifth flow paths 30*e* flows into the four sixth flow paths 30*f* formed in the third plate member 13 (the second branch).

The refrigerant flown through the four sixth flow paths 30*f* flows into the four seventh flow paths 30*g* formed by the third plate member 13, the second plate member 12, and the first plate member 11 in a direction from the rear side to the front side. The refrigerant flown through the four seventh flow paths 30*g* flows into the four eighth flow paths 30*h* formed in the first plate member 11.

The refrigerant flown through the four eighth flow paths 30*h* flows into the four ninth flow paths 30*i* formed by the first plate member 11, the second plate member 12, and the third plate member 13 in a direction from the front side to the rear side. The refrigerant flown through the four ninth flow paths 30*i* flows into the eight tenth flow paths 30*j* formed in the third plate member 13 (the third branch).

The refrigerant flown through the eight tenth flow paths 30*j* flows into the eight eleventh flow paths 30*k* formed by the third plate member 13 and the fourth plate member 14 in a direction from the front side to the rear side.

<Configuration of First Plate Member>

Figure 6:
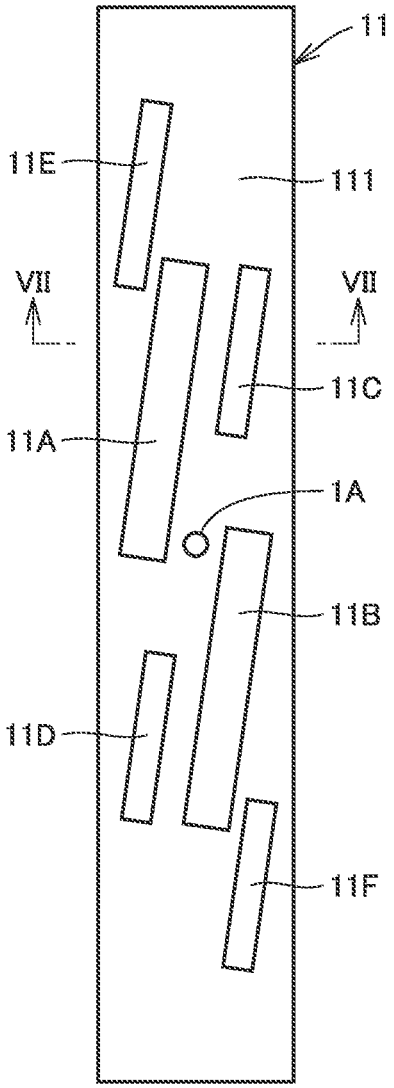
FIG. 6 is a view illustrating a first plate member.
Figure 7:
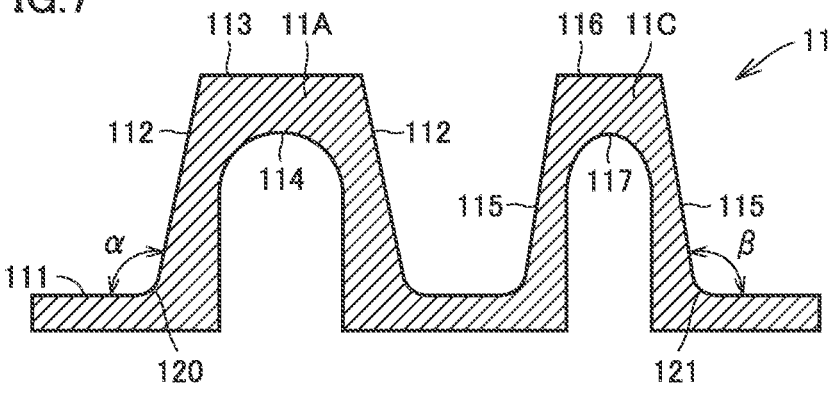
FIG. 7 is a view illustrating a cross section of the first plate member taken along a line VII-VII.

The first plate member 11 according to the first embodiment will be described below. FIG. 6 is a view illustrating the first plate member 11. FIG. 7 is a view illustrating a cross section of the first plate member 11 taken along the line in FIG. 6.

As illustrated in FIG. 6, the first plate member 11 includes a refrigerant inflow unit 1A formed by a through hole, and a plurality of convex portions 11A, 11B, 11C, 11D, 11E and 11F protruding from the main body 111 having a rectangular parallelepiped shape.

As illustrated in FIG. 7, the cross section of the first plate member 11 taken along line includes a hole 114 and a hole 117 which are provided respectively in two trapezoidal portions protruding from the main body 111 for the refrigerant to flow through. An angle α formed between the main body 111 and a side surface 112 of the convex portion 11A is 90° or more. An angle β formed between the main body 111 and a side surface 115 of the convex portion 11C is 90° or more.

A corner 120 formed between the main body 111 and the side surface 112 of the convex portion 11A has an arc shape. A corner 121 formed between the main body 111 and the side surface 115 of the convex portion 11C has an arc shape.

In the first plate member 11, an upper surface 113 of the convex portion 11A and an upper surface 116 of the convex portion 11C have the same height. When a jig is used to fix the distributor 1 to the heat transfer tube 4 by brazing, a pressure is applied from the upper surface of the first plate member 11. In the distributor 1, since the heights of the upper surfaces of the respective convex portions are the same, the pressure can be uniformly distributed. With such a configuration, it is possible for the distributor 1 to prevent the brazing material from flowing into the flow path to interfere with the distribution of the refrigerant, which makes it possible to improve the performance of the heat exchanger 10.

When the heat exchanger 10 functions as an evaporator, the distributor 1 may be configured in such a manner that the cross-sectional area of the eighth flow path 30*h* provided as the hole 117 in the convex portion 11C is equal to or smaller than the cross-sectional area of the fourth flow path 30*d* provided as the hole 114 in the convex portion 11A. For example, as illustrated in FIG. 7, the cross-sectional area of the eighth flow path 30*h* provided in the convex portion 11C is smaller than the cross-sectional area of the fourth flow path 30*d* provided in the convex portion 11A.

In recent years, in order to reduce the amount of refrigerant and improve the performance of a heat exchanger, the heat transfer tube has been made smaller. As the heat transfer tube has been made smaller in the heat exchanger, a distributor is required to be compatible with multi-branching. However, if the distributor is made compatible with multi-branching, the distributor may become large in size, and thereby, the performance of the heat exchanger is deteriorated due to a reduction in the mounting area of the heat exchanger.

In the distributor 1 of the present disclosure, a plurality of convex portions 11A, 11B, 11C, 11D, 11E and 11F are formed on the first plate member 11. According to the distributor 1 of the present disclosure, since the flow path is formed in the first plate member 11 on the outermost side, it is possible to reduce the number of stacked plates. Thus, according to the distributor 1 of the present disclosure, it is possible to reduce the mounting area of the heat exchanger by reducing the size of the distributor 1, which makes it possible to improve the performance of the heat exchanger. According to the distributor 1 of the present disclosure, it is possible to achieve weight reduction and cost reduction by reducing the size of the distributor 1.

Second Embodiment

Figure 8:
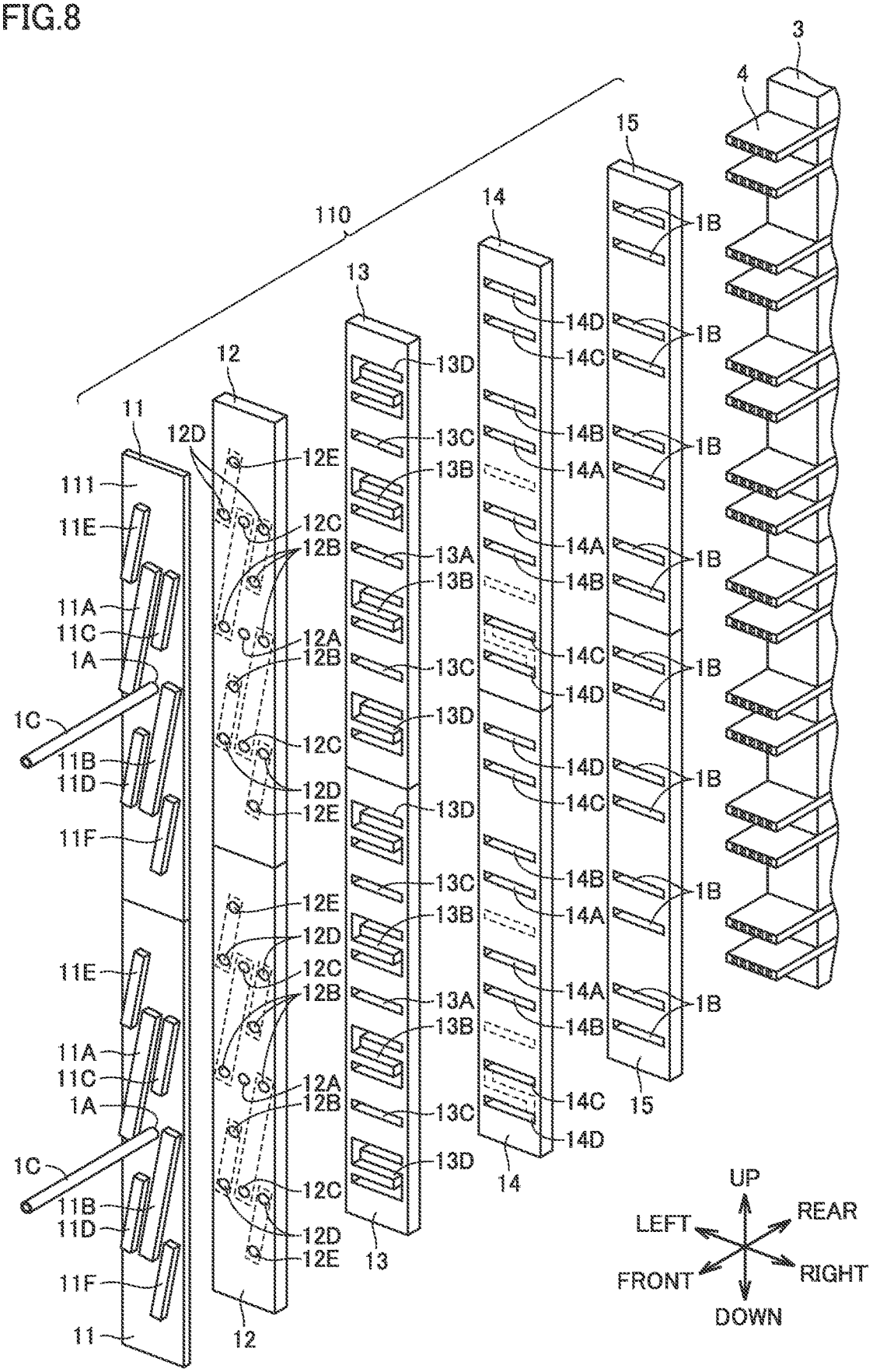
FIG. 8 is a diagram illustrating a distributor according to a second embodiment.

FIG. 8 is a diagram illustrating a distributor 110 according to a second embodiment. The distributor 110 according to the second embodiment is formed by connecting two distributors 1 according to the first embodiment in the vertical direction. The flow of the refrigerant is the same as that in the first embodiment.

Since the refrigerant flows from two refrigerant inflow units, i.e., an upper refrigerant inflow unit 1A and a lower refrigerant inflow unit 1A into the distributor 110, it is possible for the distributor 110 to distribute the refrigerant to more heat transfer tubes 4.

SUMMARY

The present disclosure relates to a distributor 1 for distributing refrigerant to each of a plurality of heat transfer tubes 4 with a space being interposed between the plurality of heat transfer tubes 4. The distributor 1 at least includes: a first flow path 30*a* through which the refrigerant flowing in from a refrigerant inflow unit 1A flows in a first direction toward the heat transfer tubes 4 disposed on the side of a refrigerant outflow unit 1B; two second flow paths 30*b* branched from the first flow path 30*a* in a direction intersecting the first flow path 30*a*; two third flow paths 30*c*, through each of which the refrigerant from a corresponding one of the two second flow paths 30*b* flows in a second direction opposite to the first direction; two fourth flow paths 30*d*, each of which is formed to protrude in the second direction from a main body 111 of the distributor 1 on the side of the refrigerant inflow unit 1A, and through each of which the refrigerant from a corresponding one of the two third flow paths flows 30*c* in a third direction intersecting each of the two third flow paths 30*c*; and two fifth flow paths 30*e*, through each of which the refrigerant from a corresponding one of the two fourth flow paths 30*d* flows in the first direction.

With such a configuration, a flow path protruding from the main body 111 in the second direction is formed in the distributor 1. Therefore, it is possible to reduce the size of the distributor 1 by reducing the overall thickness of the distributor 1 as compared with a conventional distributor in which the flow path is formed by a through hole provided in the main body 111.

Preferably, the distributor 1 is disposed in such a manner that the flow direction of the refrigerant in each of the plurality of heat transfer tubes 4 connected to the heat exchanger 10 is horizontal.

With such a configuration, it is possible to reduce the size of the distributor 1 in the horizontal direction.

Preferably, the distributor 1 further includes: four sixth flow paths 30*f*, two of which are branched from one of the two fifth flow paths 30*e* in a direction intersecting the fifth flow path 30*e* and the other two of which are branched from the other one of the two fifth flow paths 30*e* in the direction intersecting the fifth flow path 30*e*; four seventh flow paths 30*g*, through each of which the refrigerant from a corresponding one of the four sixth flow paths 30*f* flows in the second direction; four eighth flow paths 30*h*, each of which is formed to protrude in the second direction from the main body 111 on the side of the refrigerant inflow unit 1A, and through each of which the refrigerant from a corresponding one of the four seventh flow paths 30*g* flows in the third direction intersecting each of the four seventh flow paths 30*g*; and four ninth flow paths 30*i*, through each of which the refrigerant from a corresponding one of the four eighth flow paths 30*h* flows in the first direction. When the heat exchanger 10 functions as an evaporator, in the distributor 1, the cross-sectional area of each of the four eighth flow paths 30*h* is equal to or smaller than the cross-sectional area of each of the two fourth flow paths 30*d*.

When the cross-sectional area of the flow path on the upstream side is the same as that of the flow path on the downstream side, the flow volume of the refrigerant decreases after each branch, and the flow velocity of the refrigerant on the downstream side is lower than the flow velocity of the refrigerant on the upstream side. The distributor 1 is configured in such a manner that the cross-sectional area of the flow path on the downstream side is smaller than that of the flow path on the upstream side. Thus, it is possible for the distributor 1 to prevent the refrigerant from being difficult to flow upward due to gravity even when the flow volume of the refrigerant is reduced due to repeated branches, which makes it possible to improve the flow velocity of the refrigerant on the downstream side. Thus, the distributor 1 can distribute the refrigerant uniformly to the flow path.

The distributor 1 has a convex portion 11A protruding outward from the main body 111, and in a cross section orthogonal to the direction in which the refrigerant flows through the two fourth flow paths 30*d*, an angle formed between the main body 111 and the side surface 112 of the convex portion 11A is 90° or more, and the corner portion 121 formed between the main body 111 and the side surface 112 has an arc shape.

With such a configuration, it is possible to improve the pressure resistance of the distributor 1, and it is possible to reduce the size of the distributor 1 by reducing the thickness of the first plate member 11.

The distributor 1 includes a first plate member 11, a second plate member 12, a third plate member 13, a fourth plate member 14, and a fifth plate member 15, each of which is provided with holes.

With such a configuration, it is possible to form a flow path of the refrigerant in the distributor 1 by appropriately combining the holes of the respective plate members.

The heat exchanger 10 of the present disclosure includes the distributor 1 or the distributor 110 described in the embodiment. With such a configuration, it is possible to increase the mounting area of the heat exchanger 10 by an amount corresponding to the reduced size of the distributor 1 or the distributor 110, which makes it impossible to improve the performance of heat exchange.

The air conditioner 100 of the present disclosure includes the heat exchanger 10 described above. With such a configuration, it is possible to increase the mounting area of the air conditioner 100 by an amount corresponding to the reduced size of the distributor 1 or the distributor 110, which makes it impossible to improve the performance of heat exchange.

Modified Example

In the distributor 1, a plurality of convex portions 11A, 11B, 11C, 11D, 11E and 11F protruding forward from the main body 111 of the first plate member 11 form flow paths through which the refrigerant flows. In the distributor 1, a concave portion where the plate member is cut out may be used as a flow path of the refrigerant. In the distributor 1, instead of the convex portion, a pipe portion through which the refrigerant flows may be connected to the main body 111. The distributor 1 may be configured to include a combination of a convex portion, a concave portion, and a pipe portion.

In the distributor 1, the height of the convex portion protruding forward from the main body 111 of the first plate member 11 may be changed so that the cross-sectional area on the downstream side becomes equal to or smaller than the cross-sectional area on the upstream side. Specifically, in the distributor 1, it is only required to make the height of the convex portion on the upstream side higher than the height of the convex portion on the downstream side.

The distributor 1 may be configured to dispense with the fourth plate member 14 or the fifth plate member 15 among the first plate member 11, the second plate member 12, the third plate member 13, the fourth plate member 14, and the fifth plate member 15.

It should be understood that the embodiments disclosed herein are illustrative and non-restrictive in all respects. The scope of the present invention is defined by the terms of the claims rather than the description of the embodiments above, and is intended to include any modifications within the scope and meaning equivalent to the terms of the claims.

REFERENCE SIGNS LIST

1, 110: distributor; 1A, 2A: refrigerant inflow unit; 1B, 2B: refrigerant outflow unit; 1C: inflow tube; 2: header; 3: fin; 4: heat transfer tube; 10: heat exchanger; 11: first plate member; 12: second plate member; 13: third plate member; 14: fourth plate member; 15: fifth plate member; 11A, 11B, 11C, 11D, 11E, 11F: convex portion; 12A, 12B, 12C, 12D, 12E, 13A, 13B, 13C, 13D, 14A, 14B, 14C, 14D, 114, 117: hole; 21: compressor; 22: 4-way valve; 23: outdoor heat exchanger; 24: device; 25: indoor heat exchanger; 26: outdoor fan; 27: indoor fan; 28: controller; 29: extension pipe; 30*a*: first flow path; 30*b*: second flow path; 30*c*: third flow path; 30*d*: fourth flow path; 30*e*: fifth flow path; 30*f*: sixth flow path; 30*g*: seventh flow path; 30*h*: eighth flow path; 30*i*: ninth flow path; 30*j*: tenth flow path; 30*k*: eleventh flow path; 111: main body; 112, 115: side surface; 113: top surface; 120, 121: corner

The invention claimed is:

1. A distributor for distributing refrigerant to each of a plurality of heat transfer tubes with a space being interposed between the plurality of heat transfer tubes, the distributor at least comprising:

a first flow path through which the refrigerant flowing in from an inflow port flows in a first direction toward the heat transfer tubes disposed on the side of an outflow port;

two second flow paths branched from the first flow path in a direction intersecting the first flow path;

two third flow paths, through each of which the refrigerant from a corresponding one of the two second flow paths flows in a second direction opposite to the first direction;

two fourth flow paths, each of which is formed to protrude in the second direction from a main body of the distributor on the side of the inflow port, and through each of which the refrigerant from a corresponding one of the two third flow paths flows in a third direction intersecting each of the two third flow paths; and two fifth flow paths, through each of which the refrigerant from a corresponding one of the two fourth flow paths flows in the first direction.

2. The distributor according to claim 1, wherein the distributor is disposed in such a manner that the flow direction of the refrigerant in each of the plurality of heat transfer tubes connected to a heat exchanger is horizontal.

3. The distributor according to claim 2, wherein the distributor further includes:

four sixth flow paths, two of which are branched from one of the two fifth flow paths in a direction intersecting the fifth flow path and the other two of which are branched from the other one of the two fifth flow paths in the direction intersecting the fifth flow path;

four seventh flow paths, through each of which the refrigerant from a corresponding one of the four sixth flow paths flows in the second direction;

four eighth flow paths, each of which is formed to protrude in the second direction from the main body on the side of the inflow port, and through each of which the refrigerant from a corresponding one of the four seventh flow paths flows in the third direction intersecting each of the four seventh flow paths; and four ninth flow paths, through each of which the refrigerant from a corresponding one of the four eighth flow paths flows in the first direction, when the heat exchanger functions as an evaporator, in the distributor, the cross-sectional area of each of the four eighth flow paths is equal to or smaller than the cross-sectional area of each of the two fourth flow paths.

4. The distributor according to claim 3, wherein the distributor has a convex portion protruding outward from the main body, in a cross section orthogonal to the direction in which the refrigerant flows through the two fourth flow paths, an angle formed between the main body and a side surface of the convex portion is 90° or more, and an intersection formed between the main body and the side surface has an arc shape.

5. The distributor according to claim 1, wherein the distributor includes a plurality of plate members, each of which is provided with holes.

6. A heat exchanger comprising the distributor according to claim 1.

7. An air conditioner comprising the heat exchanger according to claim 6.

* * * * *